US007866081B2

(12) United States Patent
Seuk

(10) Patent No.: US 7,866,081 B2
(45) Date of Patent: Jan. 11, 2011

(54) FIREARM SUPPORT DEVICE

(76) Inventor: Jo Won Seuk, P.O. Box 245, Highland Falls, NY (US) 10928

( * ) Notice: Subject to any disclaimer, the term of this patent is extended or adjusted under 35 U.S.C. 154(b) by 81 days.

(21) Appl. No.: 11/895,044

(22) Filed: Aug. 23, 2007

(65) Prior Publication Data

US 2009/0049731 A1 Feb. 26, 2009

(51) Int. Cl.
*F41C 27/00* (2006.01)

(52) U.S. Cl. ..... 42/94; 42/75.01; 89/37.04; 73/167; 24/128

(58) Field of Classification Search ..... 42/94, 42/75.01; 89/37.04; 73/167
See application file for complete search history.

(56) References Cited

U.S. PATENT DOCUMENTS

| | | | | | |
|---|---|---|---|---|---|
| 1,350,718 | A | * | 8/1920 | Gaines | 24/128 |
| 3,012,350 | A | * | 12/1961 | Wold | 42/94 |
| 3,935,657 | A | * | 2/1976 | Wade | 42/94 |
| 3,947,988 | A | * | 4/1976 | Besaw | 42/94 |
| 4,790,096 | A | * | 12/1988 | Gibson et al. | 42/94 |
| 4,876,814 | A | | 10/1989 | Lombardo | |
| 5,056,410 | A | * | 10/1991 | Pitts | 89/37.04 |
| 5,233,779 | A | * | 8/1993 | Shaw | 42/94 |
| 5,332,185 | A | * | 7/1994 | Walker, III | 248/346.2 |
| 5,617,666 | A | * | 4/1997 | Scott | 42/94 |
| 5,758,447 | A | * | 6/1998 | Venetz | 42/94 |
| 5,875,580 | A | * | 3/1999 | Hill et al. | 42/94 |
| 6,044,747 | A | * | 4/2000 | Felts | 89/40.06 |
| 6,860,054 | B1 | * | 3/2005 | Mosher | 42/94 |
| 7,100,318 | B1 | | 9/2006 | Beltz | |
| 7,152,358 | B1 | * | 12/2006 | LeAnna et al. | 42/94 |

* cited by examiner

*Primary Examiner*—Troy Chambers
*Assistant Examiner*—Samir Abdosh
(74) *Attorney, Agent, or Firm*—R. Tracy Crump

(57) ABSTRACT

The firearm support device includes one or more "beanbags" directly mounted to a rifle stock that can be moved between a secured transportation position held against the stock and a support position suspended beneath the stock. The support device includes a stock attachment and one or more beanbags pivotally connected to the stock attachment. The stock attachment includes cinch and stirrup straps that secure the support devices to the stock and prevent it from inadvertently sliding up the stock. The bean bags are constructed of cloth pouches filled with a granular substance. The beanbags are sewn directly to the cinch strap or connected to the cinch strap by a slide buckle that rides along a rail strap sewn to a beanbag. The beanbags are securely held against the sides of the rifle stock in the transportation position by elastic cords, buckles, snaps, hook and loop fastening patches or other connection mechanisms.

9 Claims, 24 Drawing Sheets

FIREARM SUPPORT DEVICE

This invention relates to firearm support devices for long distance shooting, and in particular, a firearm support device using "beanbags" mountable to a rifle stock.

BACKGROUND OF THE INVENTION

Snipers and other precision tactical shooters often use "beanbags" under the rear of the rifle stock to support and stabilize the weapon during long distance shooting. Minimizing weapon movement is critical to precision long distance shooting and beanbags help isolate the weapon from slight movements caused by the shooter's breathing and heartbeat. These beanbags are enclosed cloth bags filled with beans, corn, sand, plastic pellets other granular substances. With the shooter lying in a prone shooting position on the ground or shooting from a bench or other stable platform, the shooter supports the stock atop the beanbags, which rests on the ground or supporting platform. The shooter further supports the stock by grasping the beanbag with his non-shooting hand while pressing the stock against his shoulder. The shooter's steady grip on the beanbag stabilizes the weapon. In addition to supporting and stabilizing the weapon, the beanbags also allow the shooter to subtly adjust the elevation of the stock by increasing or decreasing his grip on the beanbag.

In tactical applications where snipers must move to shooting positions quietly and undetected, the use of beanbags simply add to the collection of gear the shooter must carry and manage. Individual beanbags must be packed or carried with other gear between shooting positions. Some tactical beanbags have been developed that are tethered together and tied to the weapon's sling mounts with straps or cords. These tethered beanbags bounce and flail about the weapon as the shooter moves to his shooting positions. In applications where stealth is critical, the movement and noise of tethered beanbags is undesirable and potentially dangerous.

SUMMARY OF THE INVENTION

The present invention seeks to provide a firearm support device that includes one or more beanbags directly mounted to a rifle stock that can be moved between a secured transportation position held against the sides of the stock and a support position suspended beneath the stock. Each embodiment of the support device includes a stock attachment and one or more beanbags pivotally connected to the stock attachment. The stock attachment includes cinch and stirrup straps that secure the support devices to the stock and prevent it from inadvertently sliding up the stock. The bean bags are constructed of cloth pouches filled with plastic pellets or other granular substances. The beanbags are sewn directly to the cinch strap or connected to the cinch strap by a slide buckle that rides along a rail strap sewn to a beanbag. The beanbags are securely held against the rifle stock in the transportation position by elastic cords, buckles, snaps, hook and loop fastening patches or other connection mechanisms.

Because the beanbags are directly mounted to the weapon, the shooter has less gear to pack and manage while moving between shooting positions. With the beanbags secured tightly against the rifle stock in the transportation position, the shooter can move stealthfully between shooting positions with the beanbags ready and accessible for immediate deployment. The mechanism used to secure the beanbags in transportation also ensures that deployment of the beanbags is quick, silent and effortless. Each embodiment of the support device allows the beanbags to be manipulated to support and adjust the elevation of the stock. Other embodiments of the support device allow the beanbags to be used in different physical orientations while still being pivotally connected to the rifle stock for movement between the transportation and support position.

Theses and other advantages of the present invention will become apparent from the following description of an embodiment of the invention with reference to the accompanying drawings.

BRIEF DESCRIPTION OF THE DRAWINGS

The drawings illustrate different embodiments of the present invention, in which.

DESCRIPTION OF THE PREFERRED EMBODIMENT

Figure 1:
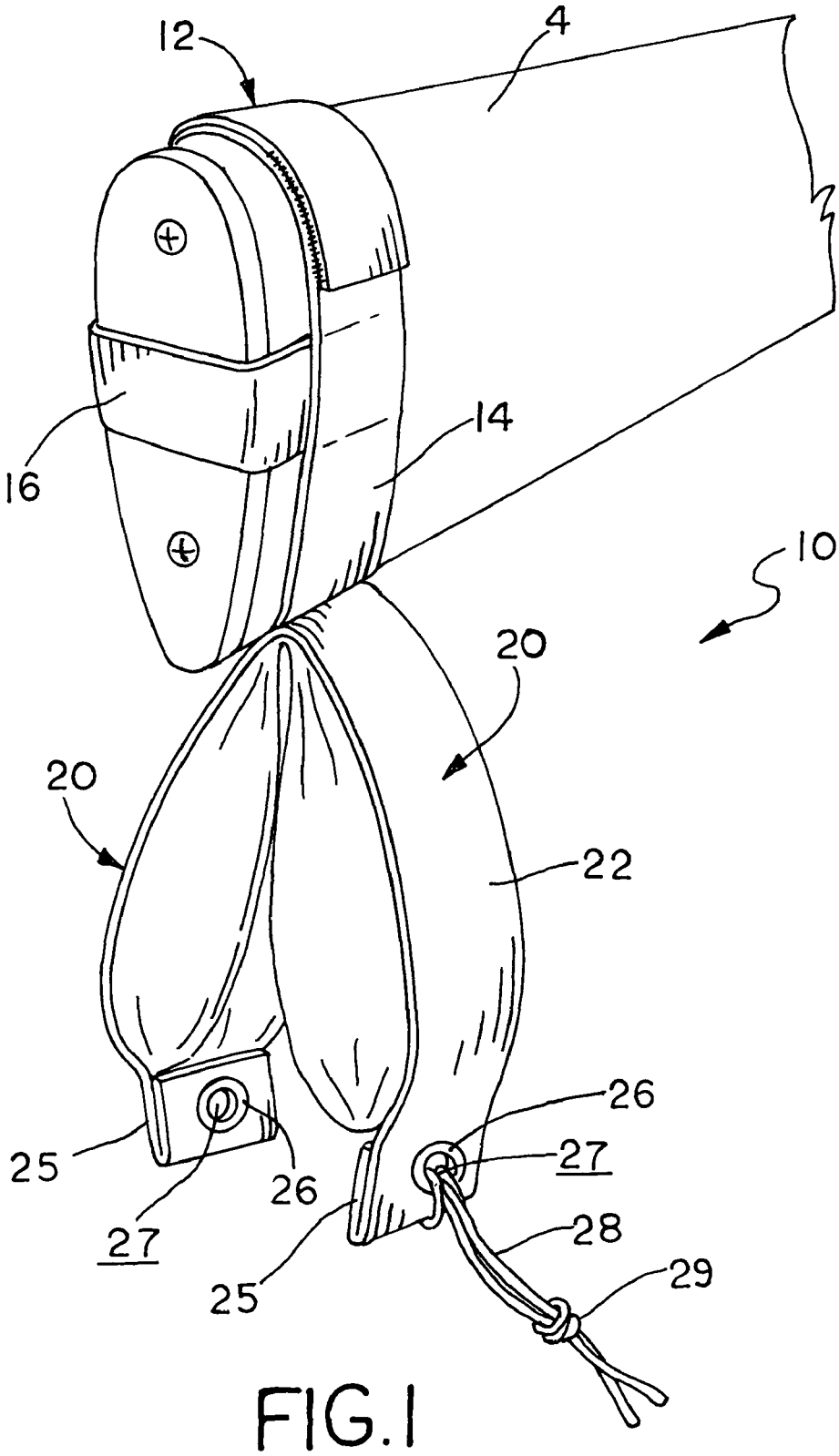
FIG. 1 is a perspective view of an embodiment of a firearm support device mounted to a rifle stock, showing the bean bags in the "support" position.

Referring now to the drawings, each embodiment of the firearm support device of this invention consists of a stock attachment and one or more "bean bags" pivotally connected to the stock attachment to allow the bean bags to move between a suspended "support" position beneath the rifle stock and a "transportation" position secured against the side of the rifle stock. The bean bags of each embodiment consist generally of a cloth pouch filled with pellets or sand. Ideally, the pouch fabric is a durable, water resistant nylon, such as Cordura® from INVISTA, but may be any natural or synthetic cloth or fabric, which resists water, tears, abrasions and scuffs. The weight of the pouch fabric is selected so that the beans bags are pliable when grasped and squeezed. The pouch fabrics are also colored and camouflaged to match the weapon to which they are mounted. Each pouch is filled with plastic pellets, although the pouches can be filled with other granular substances, such as sand, beans, corn, gravel and the like. Ideally, beanbags should be filled with inert and hydrophobic materials. The construction of the support devices generally uses lengths of nylon straps and webbing, but may use leather, cloth or suitable materials. Other construction components, such as buckles, snaps, D-rings, grommets and other components are selected for strength and, durability and to reduce light reflection, as well as, noise and clatter.

FIGS. 1-8 show a firearm support device embodiment of the present invention, which is designated generally as reference numeral 10. As shown, support device 10 includes a stock attachment 12 and a pair of bean bags 20 and 22. Stock attachment 12 is designed to mount support device 10 to any convention rifle or firearm stock. Stock attachment 12 includes a cinch strap 14, which wraps around rifle stock 4 and a stirrup strap 16, which extends around the back of the stock. Cinch strap 14 is secured around stock 4 using a buckle 15 sewn to one end and patches of hook and loop fasteners 17 sewn to the strap webbing. Alternatively, cinch strap 14 may be secured around the stock using buckles, snaps or other fastening methods for cinching the strap around the stock. The taper of the stock prevents cinch strap 14 from sliding off the back of rifle stock 4 and stirrup strap 16 prevents the cinch strap from sliding forward on the stock.

Beanbags 20 have generally an oblong shape formed by the enclosed cloth pouch filled with plastic pellets (not shown). Beanbags 20 are connected by a nylon spine web 22 which, runs longitudinally over the back of the beanbags. The ends of spine web 22 extend past the bottom of each beanbag and are doubled over to form an end tab 25. Each spine end tab 25 has a metal eyelet 27. The mid point of spine web 22 between bean bags 20 is sewn to the bottom of cinch strap 14 connecting the bean bags to stock attachment 12. A length of elastic cord 28 is knotted together to from a loop and tied to one of the spine end tabs 25 through a metal grommet 26 having an eyelet 27. Ideally, elastic cord 28 is constructed of continuous rubber strands with an outer nylon sheath. This type of elastic cord is well known and commonly referred to as bungee or shock cord. The knotted end 29 of elastic cord 28 provides a silent and snag free connection mechanism for securing bean bags 20 in the transportation position.

Figure 2:
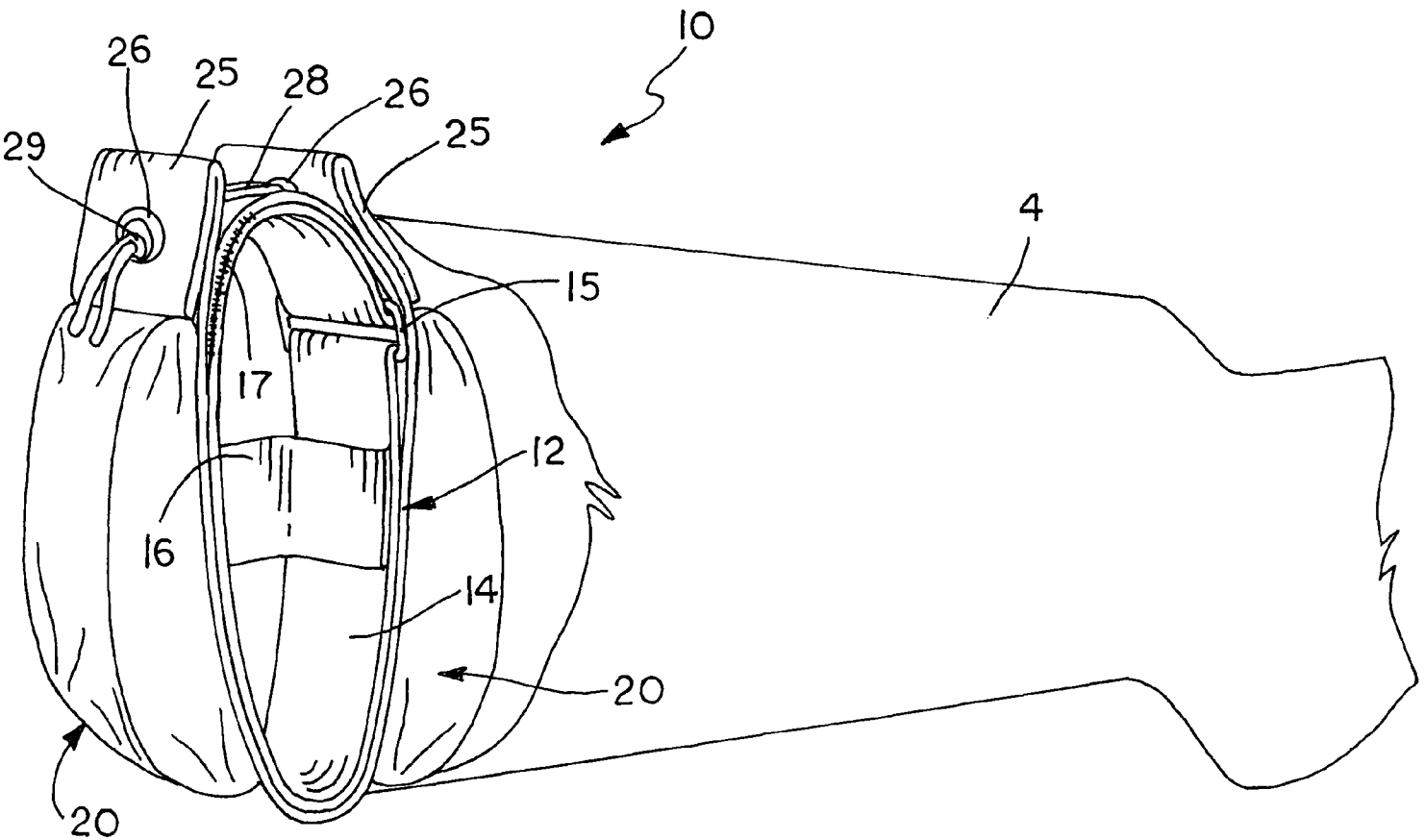
FIG. 2 is a perspective view of the embodiment of FIG. 1 mounted to a rifle stock, showing the bean bags secured to the stock in the "transportation" position.
Figure 3:
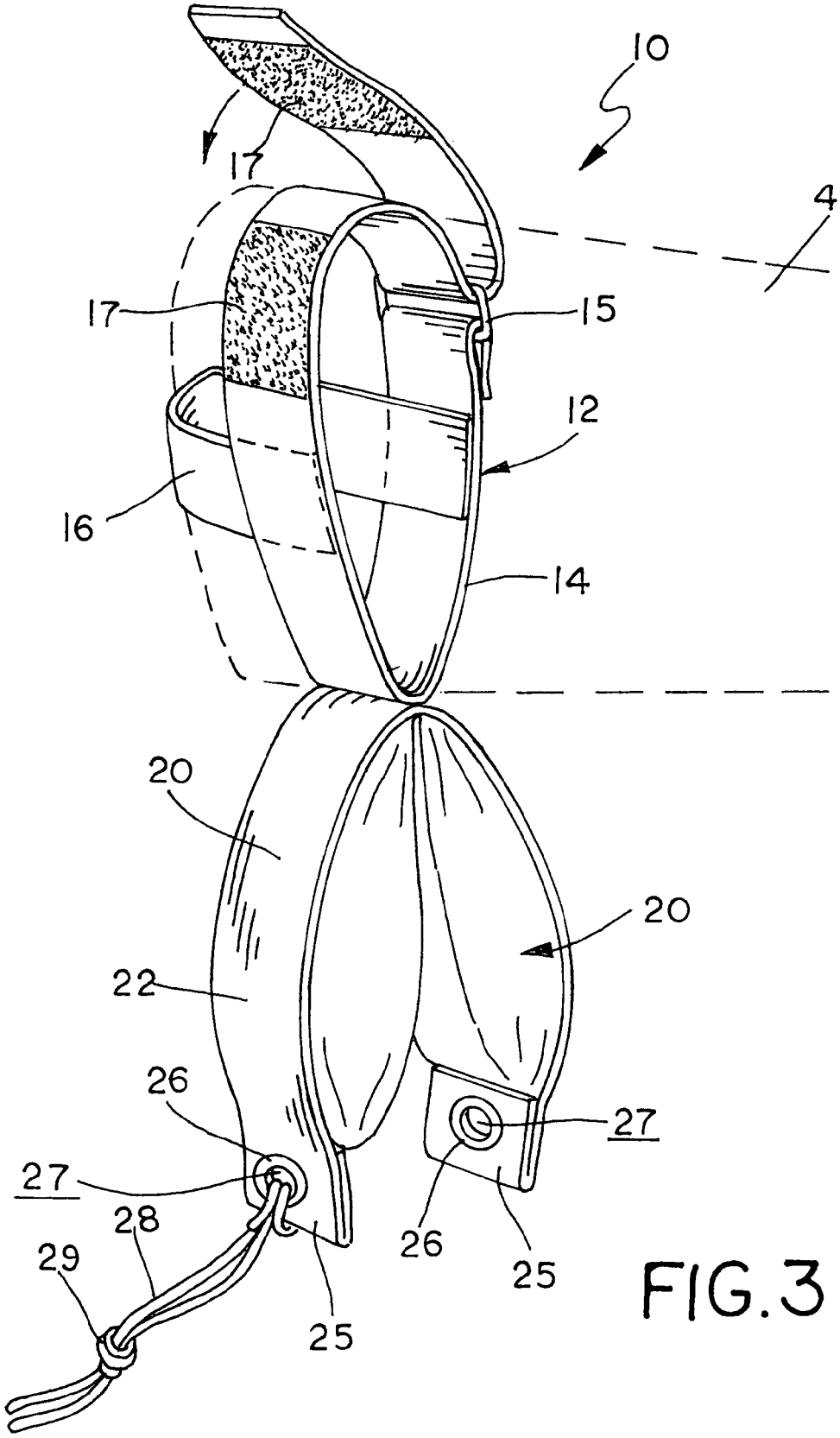
FIG. 3 is another perspective view of the embodiment of FIG. 1, showing the connection of the stock attachment to the rifle stock.
Figure 4:
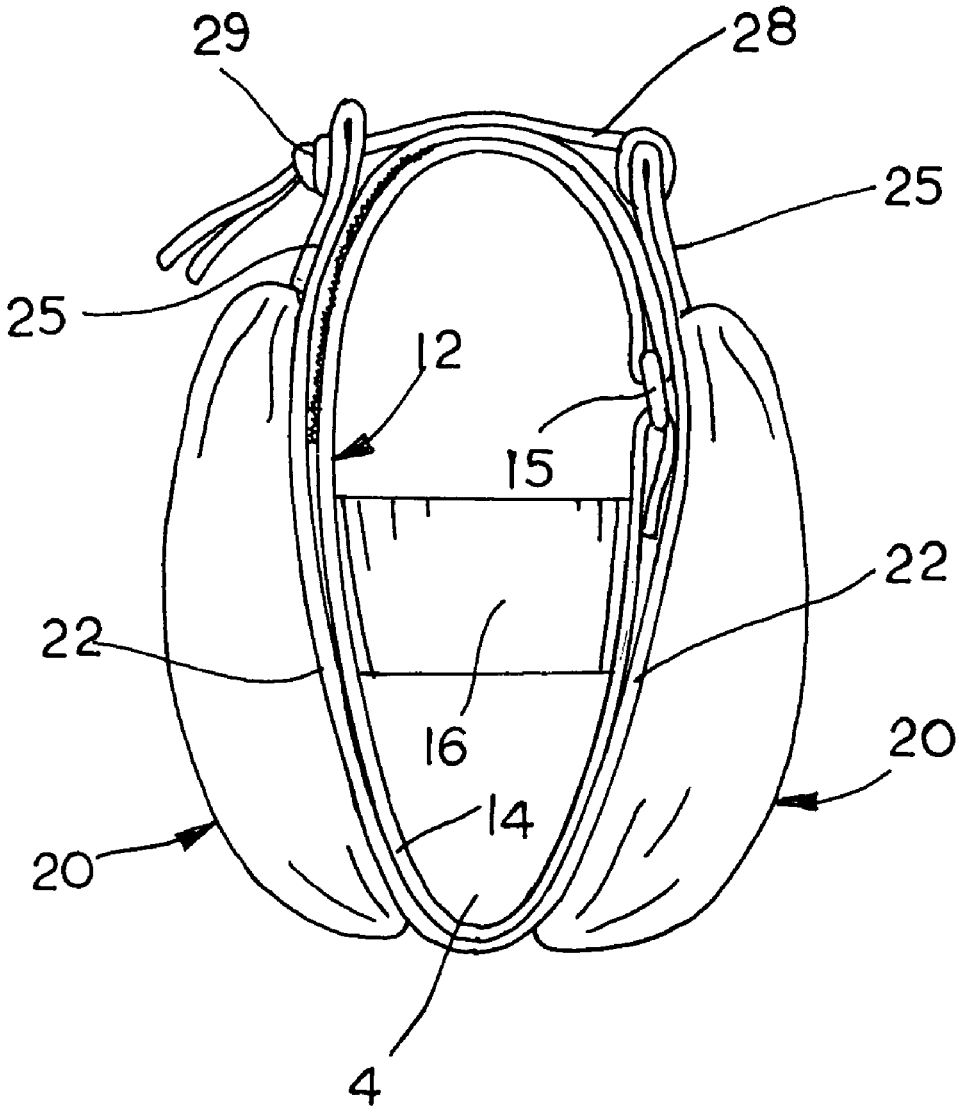
FIG. 4 is an end view of the embodiment of FIG. 1 showing the bean bags in the transportation position.
Figure 5:
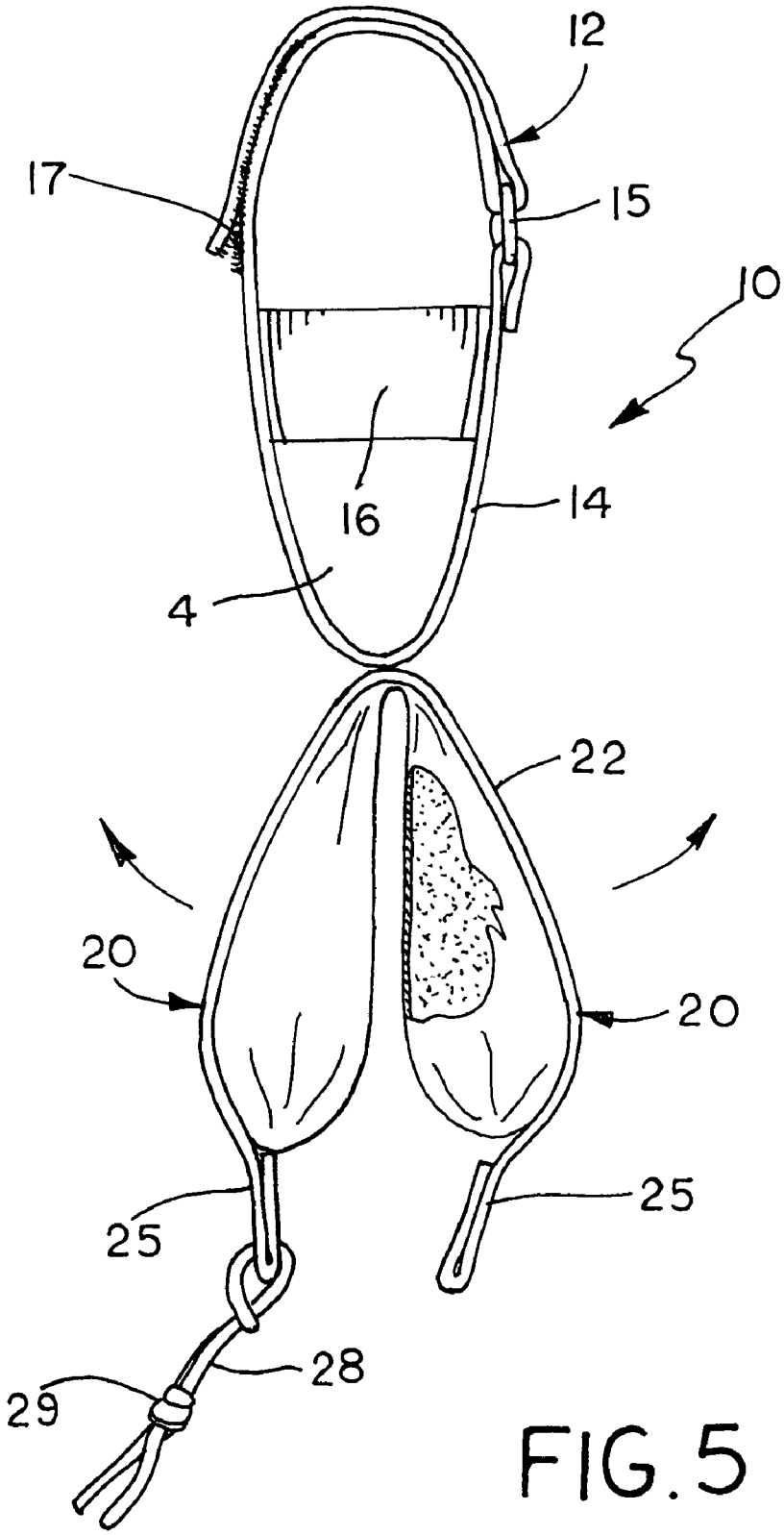
FIG. 5 is an end view of the embodiment of FIG. 1 showing the bean bags in the support position.

FIGS. 2 and 4 show support device 10 with bean bags 20 secured in the transportation position. In the transportation position, bean bags 20 are folded up against the side of the rifle stock and secured by elastic cord 28. Knotted end 29 of elastic cord 28 is pulled over the top of the stock and through eyelet 26 of the opposite spine tab 25. Knotted end 29 of elastic cord 28 must be forcefully pulled through eyelet 27 by the shooter to secure bean bags 20 in the transportation position. The size of the knot prevents knotted end 29 of the elastic cord from inadvertently being pulled back through eyelet 27; however, the elasticity of elastic cord 28 allows the shooter to intentionally pull the knotted end through the eyelet with only minimal force and effort. While secured in the transportation position, bean bags 20 are held fast against the sides of stock 4 so that they will not bounce or move about loose as the shooter moves between shooting positions with the weapon.

Figure 6:
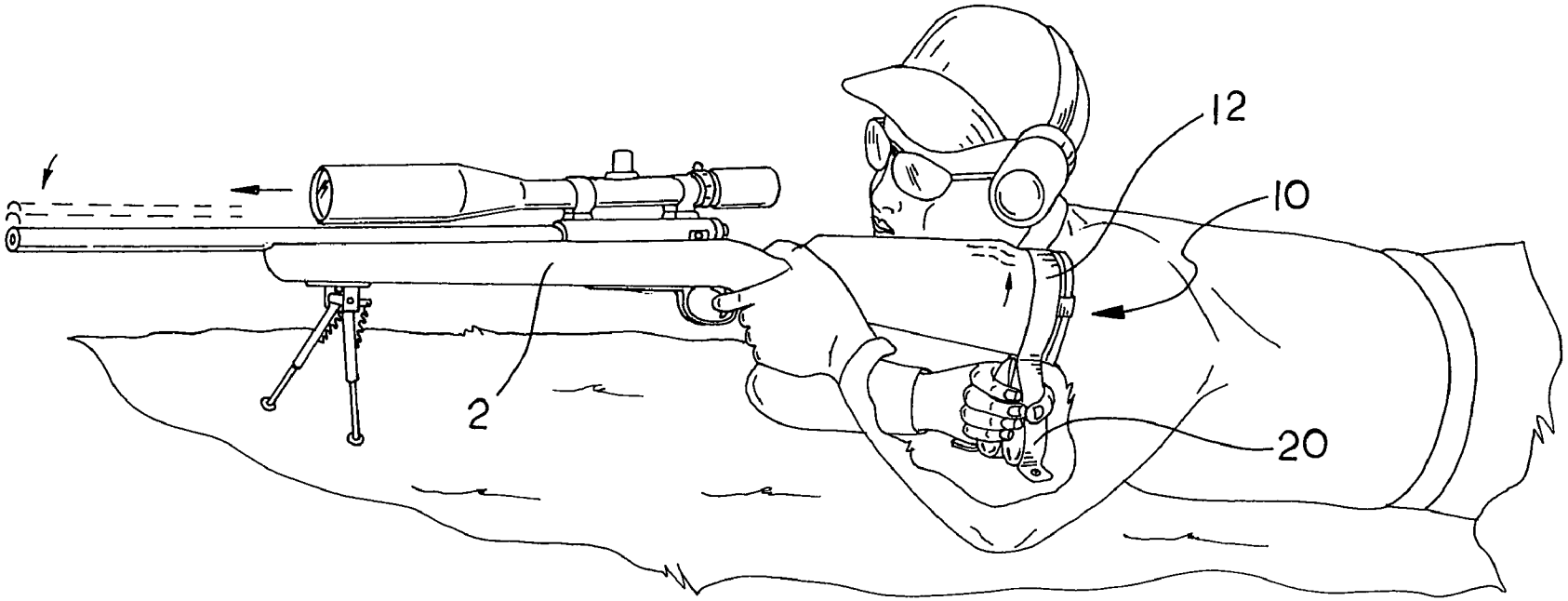
FIG. 6 is a perspective view of a shooter using the embodiment of FIG. 1 on the rifle stock to adjust and support the rifle in a prone shooting position.
Figure 7:
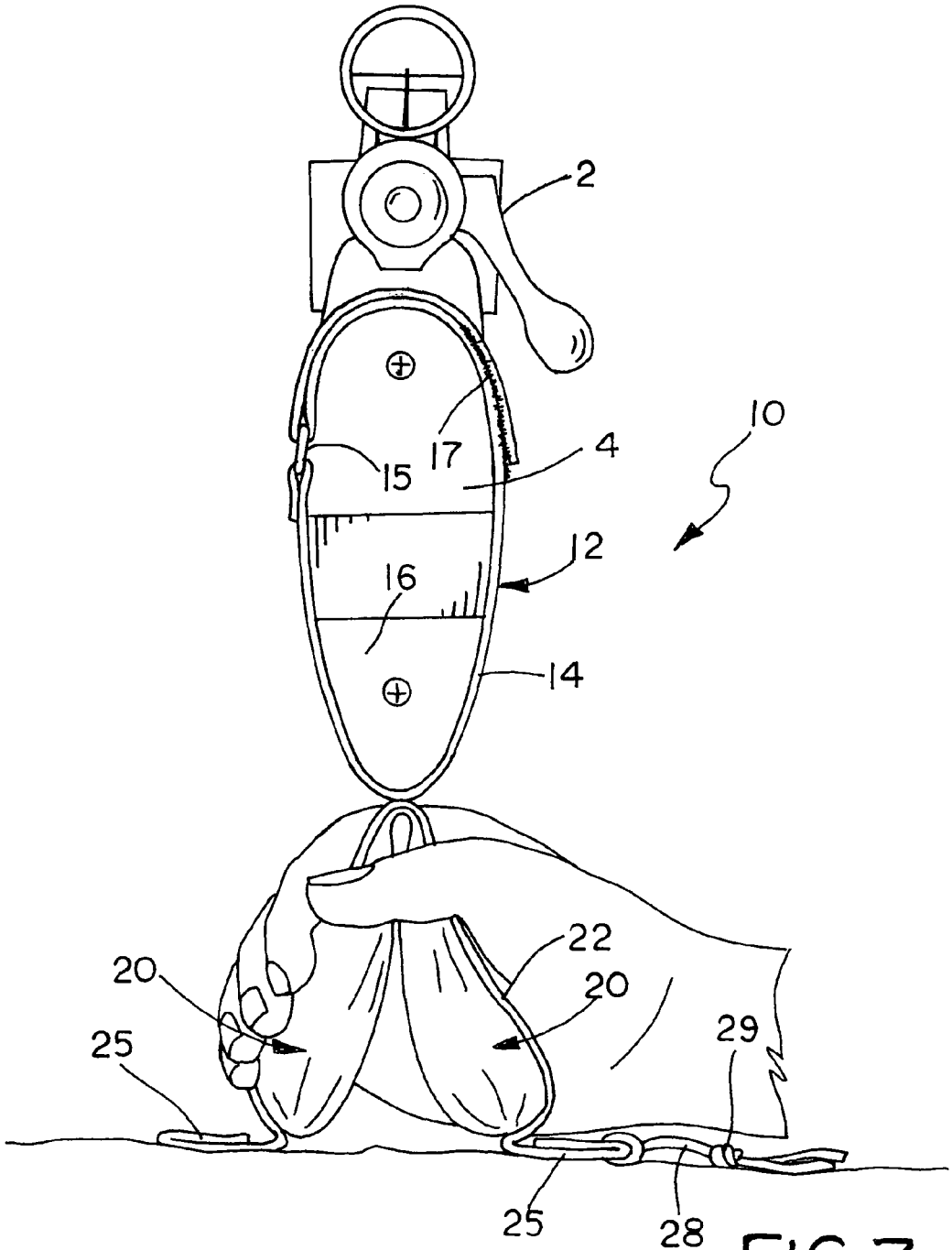
FIGS. 7 and 8 are end views of the embodiment of FIG. 1 showing how the shooter's grasp of the bean bags supports and adjusts the position of the rifle stock.
Figure 8:
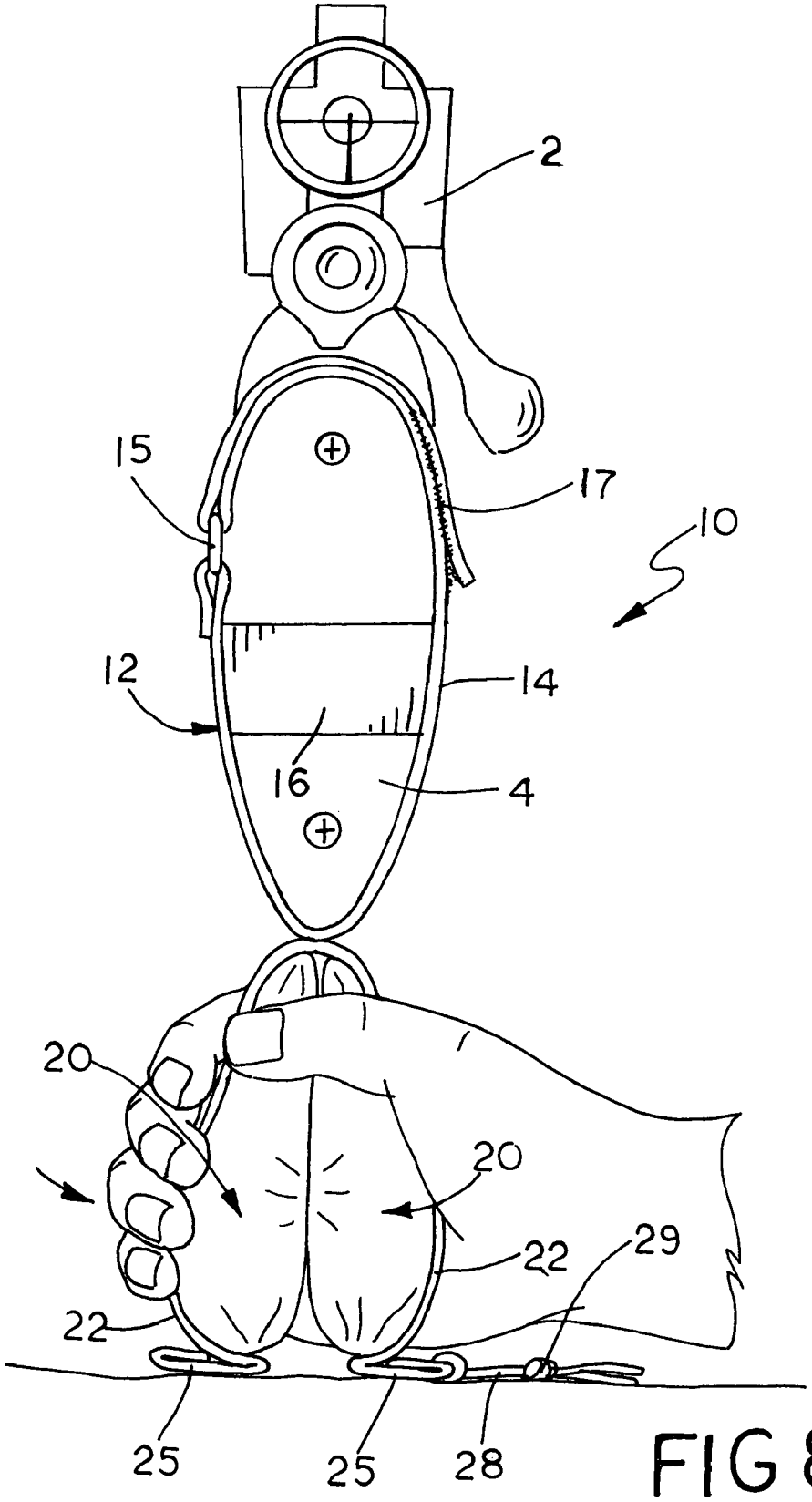
Figure 9:
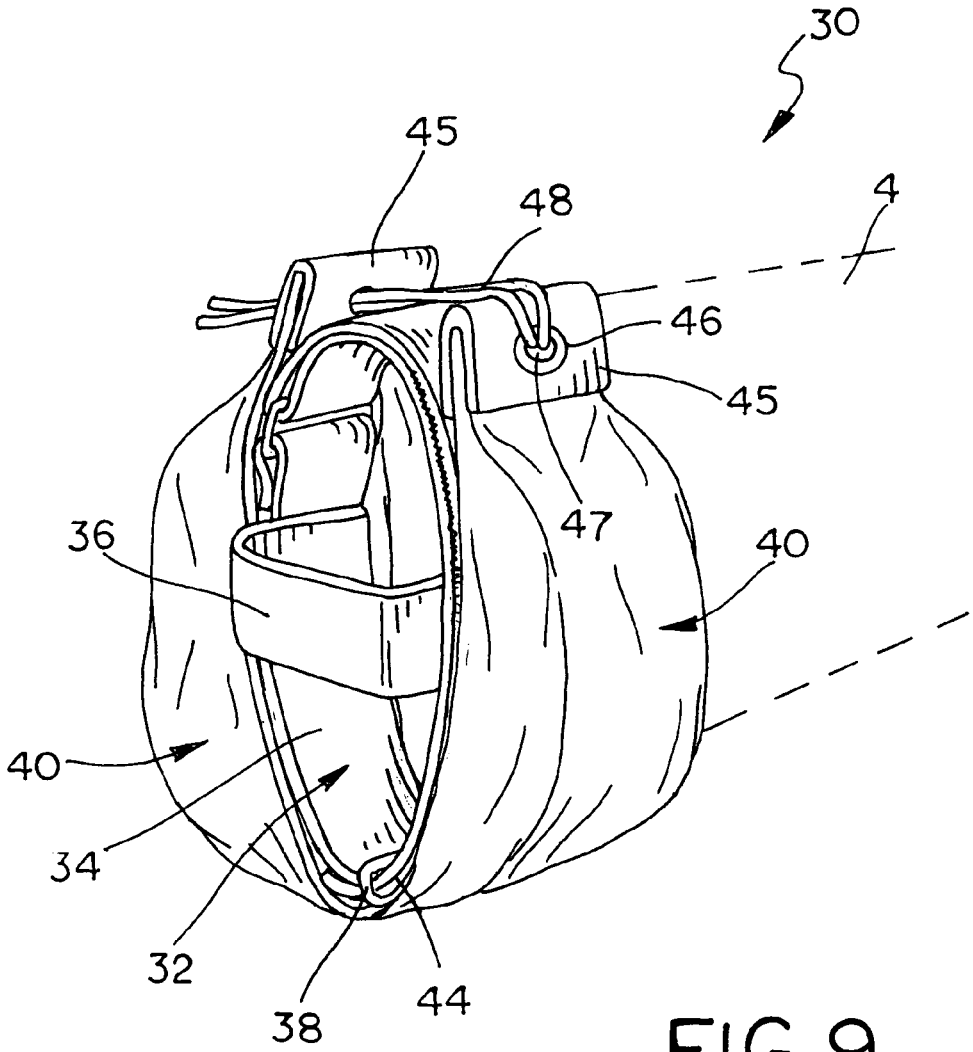
FIG. 9 is a perspective view of a second embodiment of a firearm support device mounted to a rifle stock, showing the bean bags in the "transportation" position.
Figure 10:
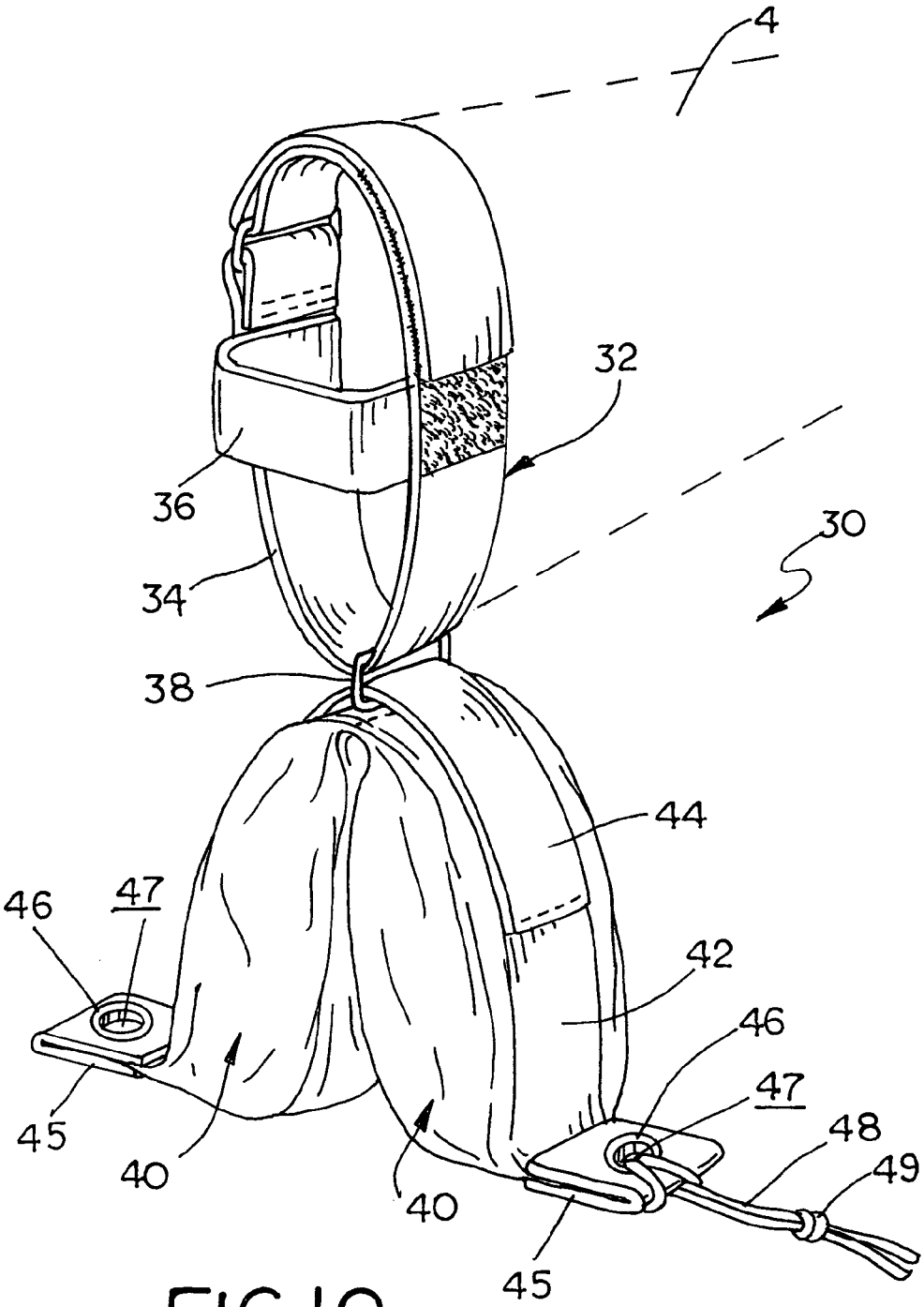
FIG. 10 is perspective view of the embodiment of FIG. 9 mounted to a rifle stock, showing the bean bags secured to the stock in the "support" position.
Figure 11:
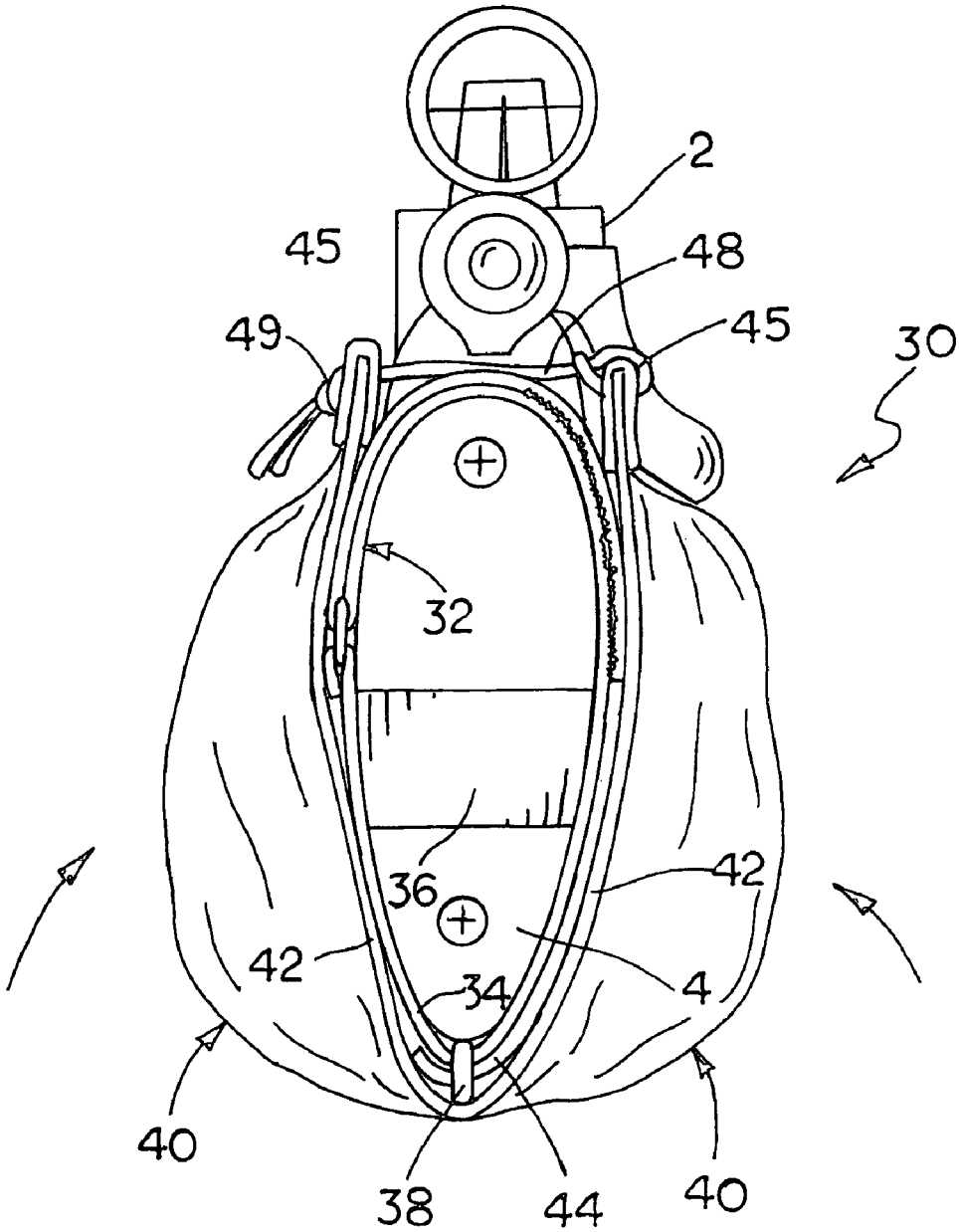
FIG. 11 is an end view of the embodiment of FIG. 9 showing the bean bags in the transportation position.
Figure 12:
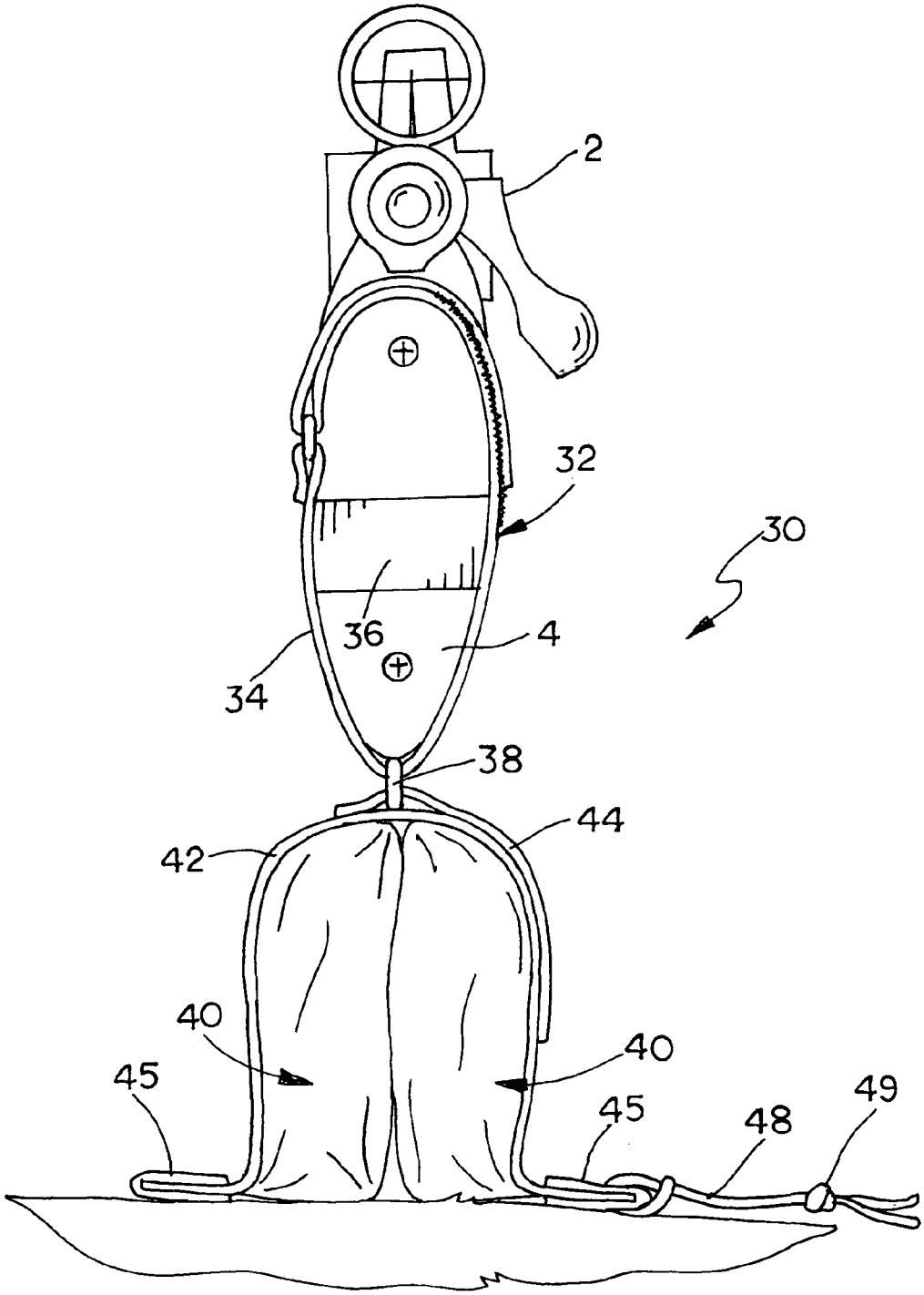
FIG. 12 is an end view of the embodiment of FIG. 9 showing the bean bags in the support position in a side-by-side orientation.

FIGS. 1, 3, 5-8 show firearm support device 10 with bean bags 20 suspended from stock attachment 12 in the support position below stock 4. As best shown in FIG. 6, the shooter can rest and stabilize the butt end of rifle stock 4 atop bean bags 20 while shooting from a prone position or while shooting from a bench rest or other similar structure. The shooter grasps one or both of bean bags 20 and squeezes them to subtly raise and lower the butt end of rifle stock 4. A steady grip on bean bags 20 supports and stabilies rifle stock 4 and helps isolate the weapon from the shooter's breathing and heart beat.

Figure 13:
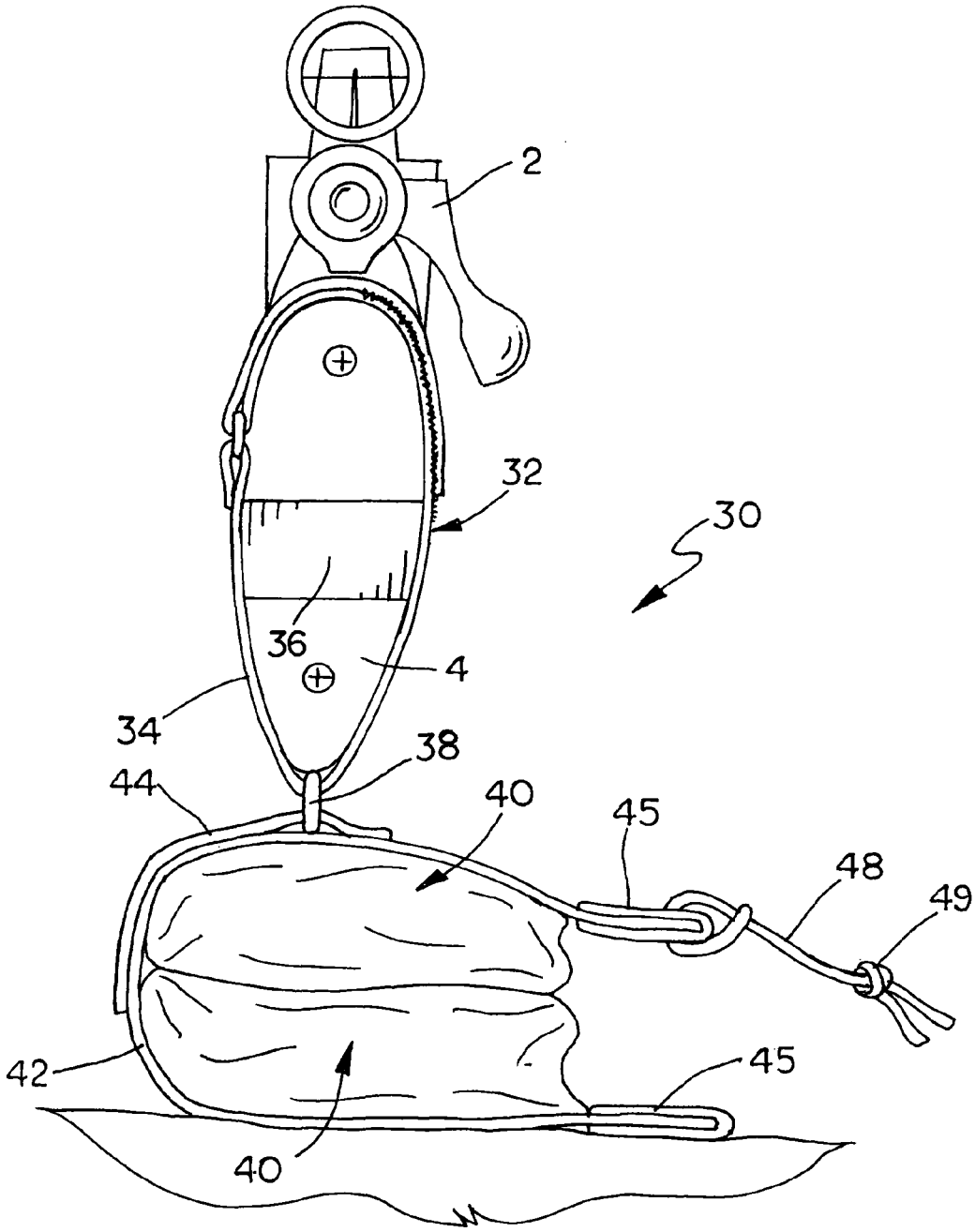
FIG. 13 is an end view of the embodiment of FIG. 9 showing the bean bags in the support position in a stacked orientation.
Figure 14:
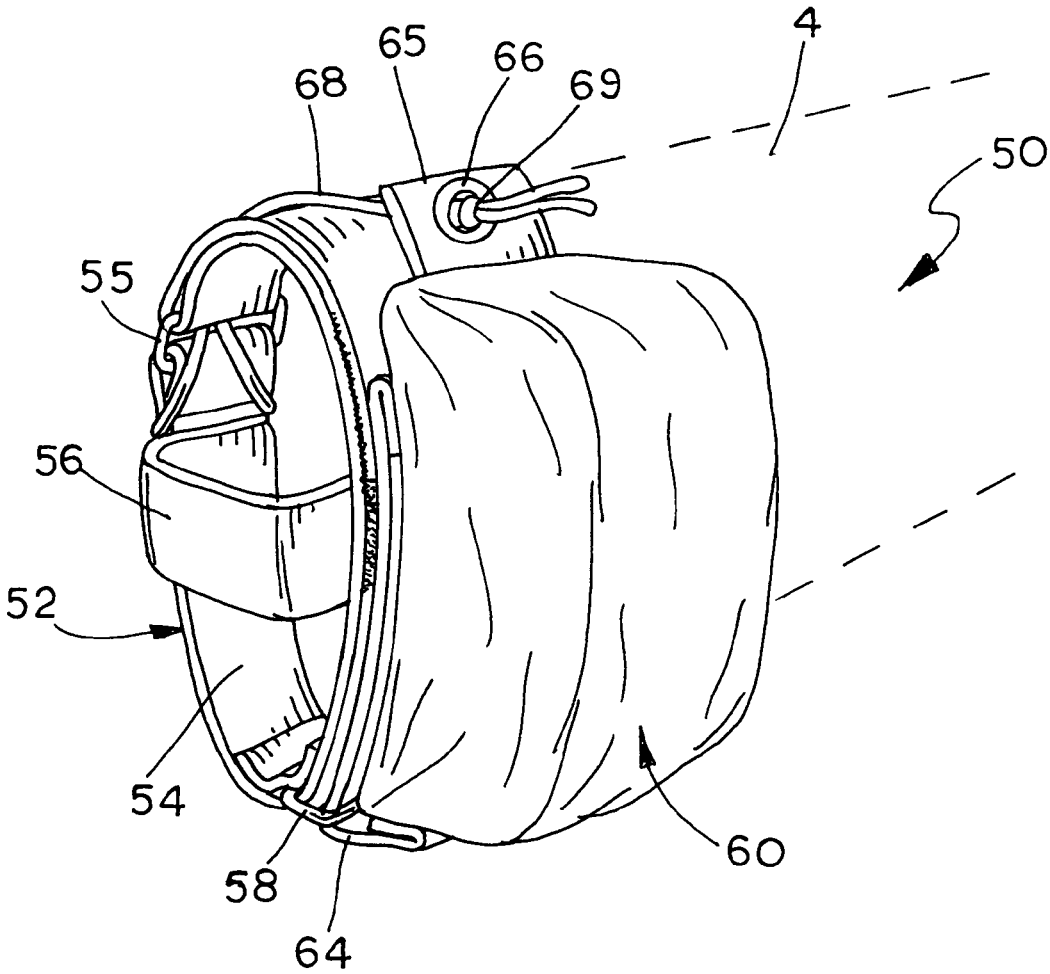
FIG. 14 is a perspective view of a third embodiment of the firearm support device mounted to a rifle stock, showing the bean bags in the "transportation" position.
Figure 15:
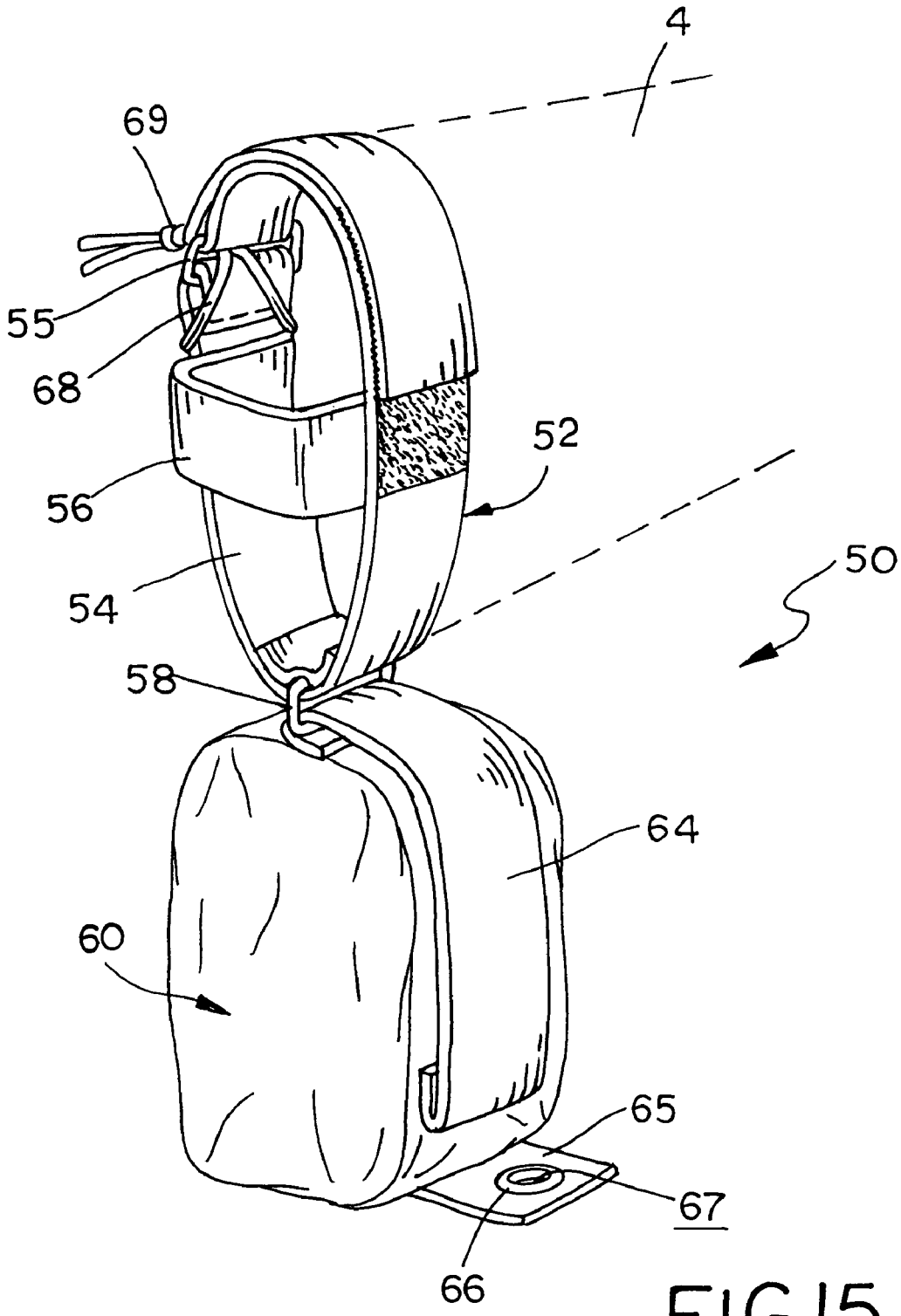
FIG. 15 is a perspective view of the embodiment of FIG. 14 mounted to a rifle stock, showing the bean bag secured to the stock in the "support" position.
Figure 16:
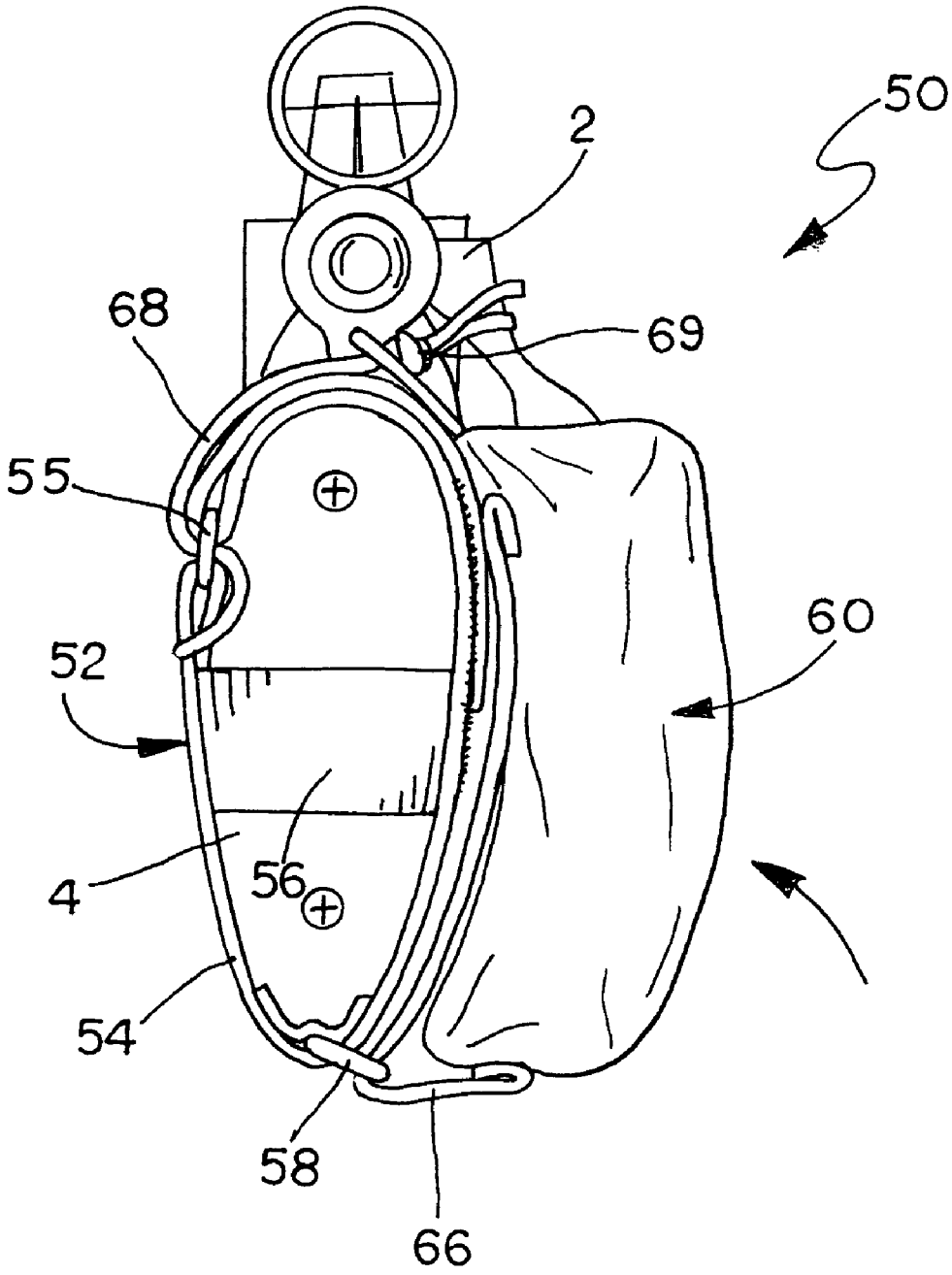
FIG. 16 is an end view of the embodiment of FIG. 14 showing the bean bag in the transportation position.
Figure 17:
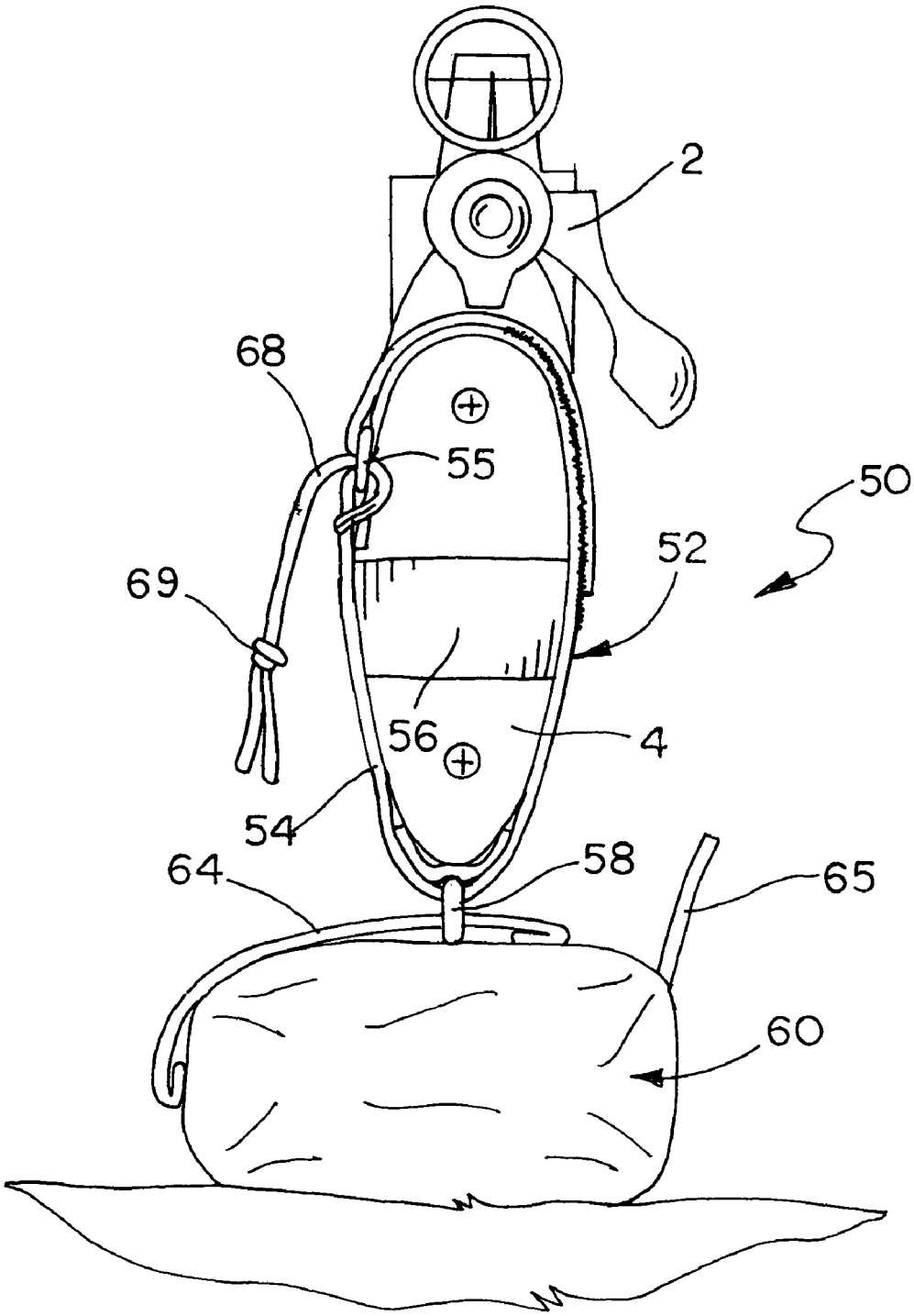
FIG. 17 is an end view of the embodiment of FIG. 14 showing the bean bag in the support position in a horizontal orientation.
Figure 18:
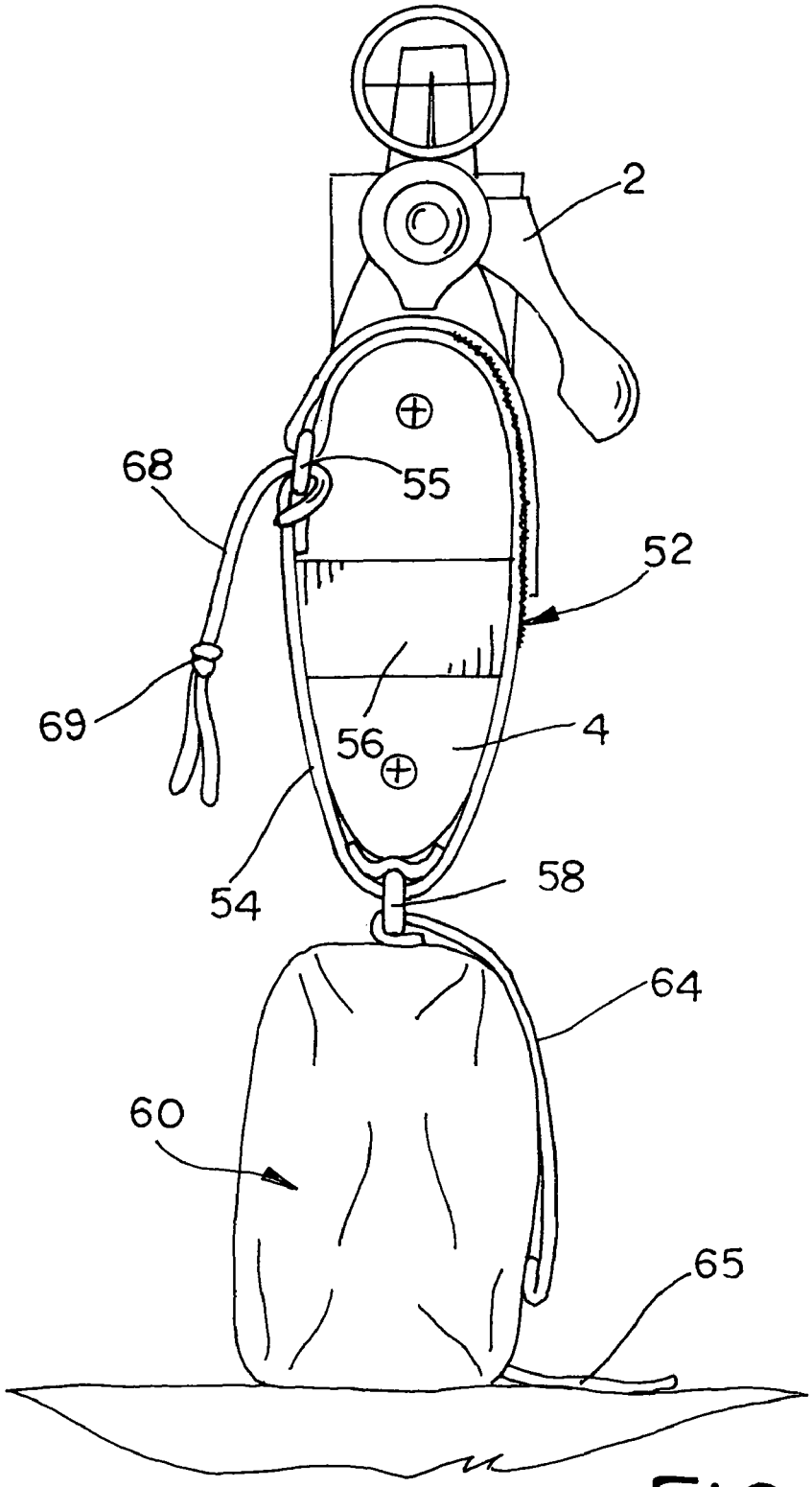
FIG. 18 is an end view of the embodiment of FIG. 14 showing the bean bag in the support position in a vertical orientation.

FIGS. 9-13 illustrate a second firearm support device embodying this invention, which is designated generally as reference numeral 30. Firearm support device 30 is similar in construction to support device 10, but allows the bean bags to be used in a side-by-side orientation or in a stacked orientation. Support device 30 includes a stock attachment 32 and a pair of bean bags 40. Support device 30 includes an additional rail strap 44 sewn parallel over spine web 42. As shown, one end of rail strap 44 is sewn to spine strap 42 just past the mid point of spine web 42 at the proximal end of one of beanbags 40. The other end of rail strap 44 is sewn to spine strap 42 near the middle of the same beanbag 40. Bean bags 40 are shiftably connected to stock attachment 32 by a plastic or metal D-ring 38, through which cinch strap 34 and rail strap 44 extend. D-ring 38 can slide along the length of rail strap 4 to allow bean bags 40 to be used in a side-by-side orientation (FIGS. 10 and 12) or in a stacked orientation (FIG. 13). To move to the transportation position, D-ring 38 is slid to the end of rail strap 44 between bean bags 40 and bean bags 40 are folded upward against stock 4 and secured by again a knotted elastic cord 48 as with support device 10 described above. Beanbags 40 include a web tab 45 and a grommet 46 with an eyelet 47. The knotted end 49 of elastic cord 48 is held securely through grommet eyelet 47.

FIGS. 14-18 illustrate a third firearm support device embodying this invention, which is designated generally as reference numeral 50. Support device 50 is similar in construction to support devices 10 and 30, but uses a single large beanbag 60 pivotally connected to stock attachment 52. As shown, beanbag 60 has a rectangular "brick" shape. Again, beanbag 60 is shiftably secured to stock attachment 52 by a D-ring 58 that rides along the length of a rail strap 64 sewn to beanbag 60. In a shooting position, D-ring 58 and rail strap 64 allow bean bag 60 to be used in a horizontal orientation (FIG. 17) or a vertical orientation (FIG. 18) to stock 4. In the transportation position, bean bag 60 is once again secured by knotted elastic cord 68. The looped end of elastic cord 68 is tied to the cinch buckle 55 of cinch strap 54 and the knotted end 69 of elastic cord 68 is held securely through eyelet 67 of grommet 66 in a web tab 65.

Figure 19:
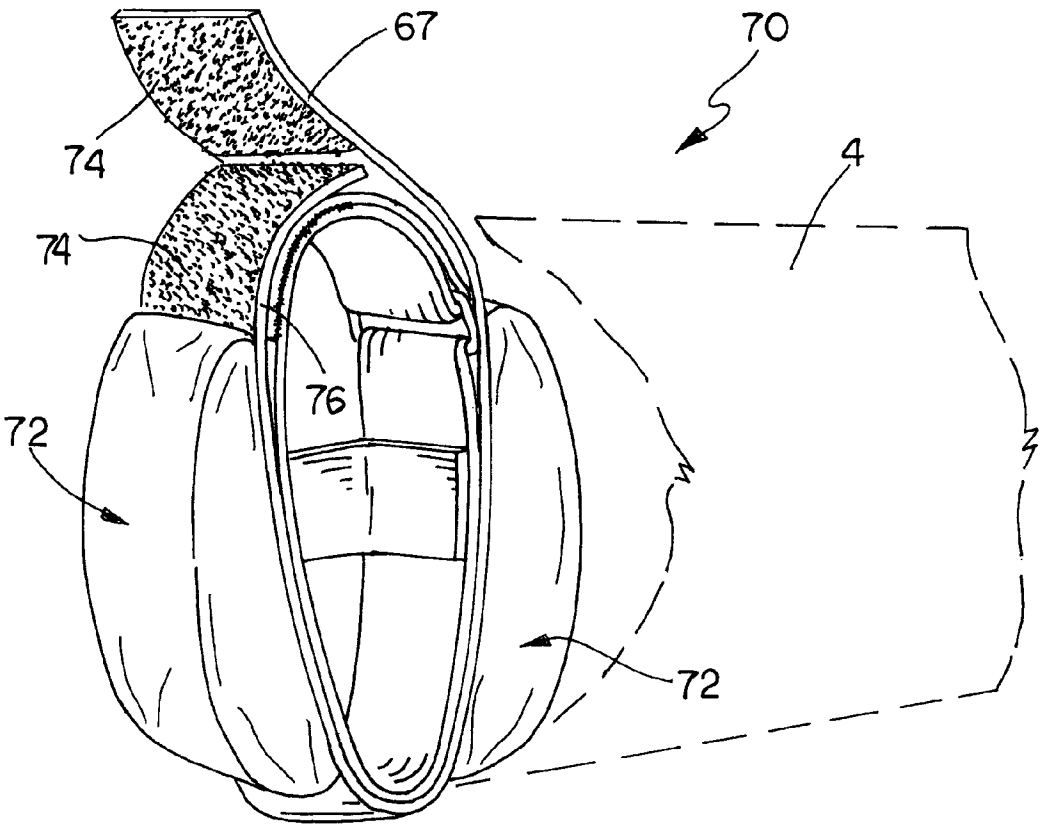
FIG. 19 is a perspective view of a fourth embodiment of the firearm support device.
Figure 20:
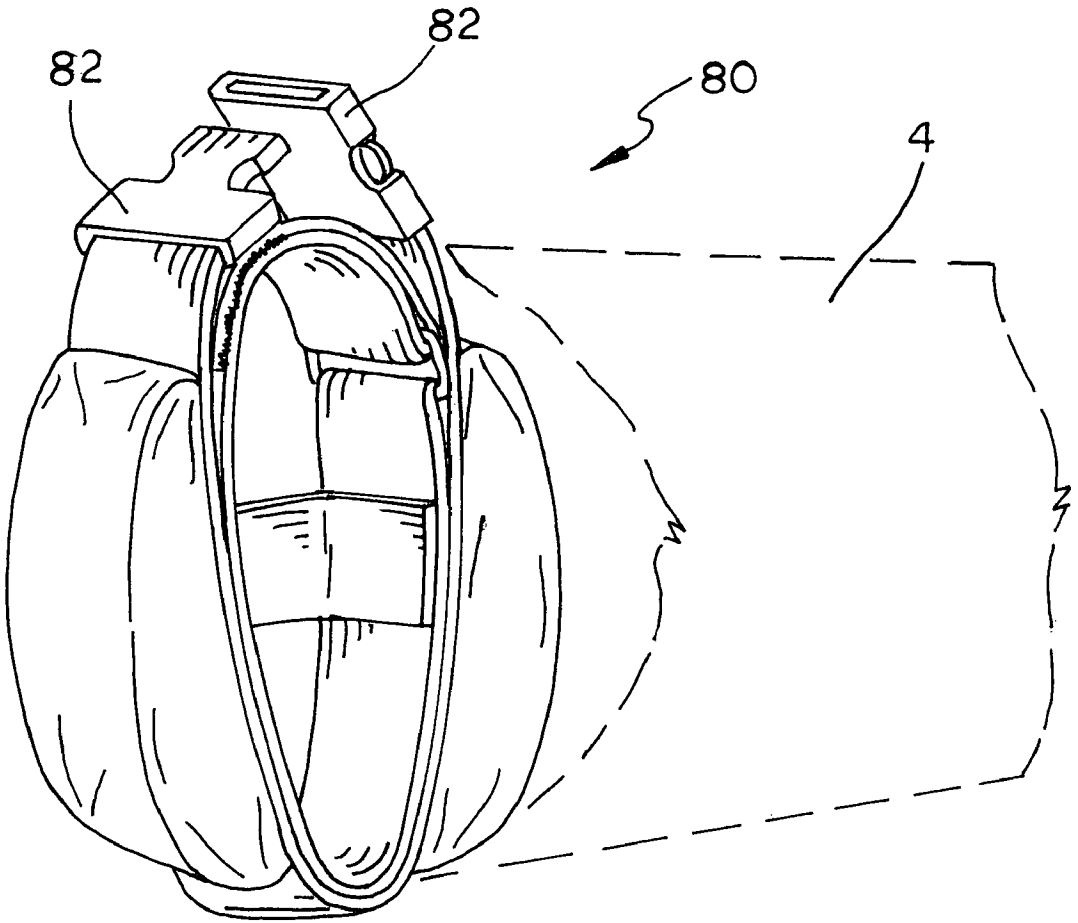
FIG. 20 is a perspective view of a fifth embodiment of the firearm support device.
Figure 21:
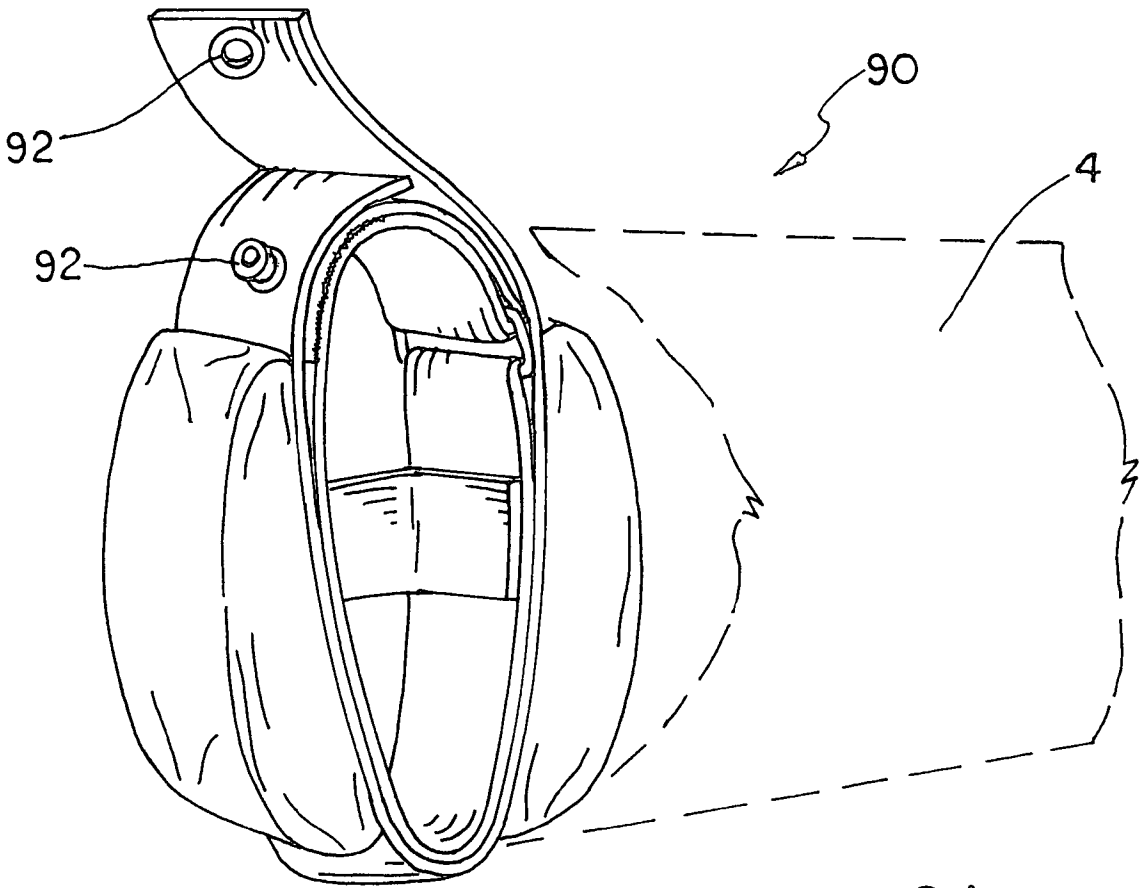
FIG. 21 is a perspective view of a sixth embodiment of the firearm support device.
Figure 22:
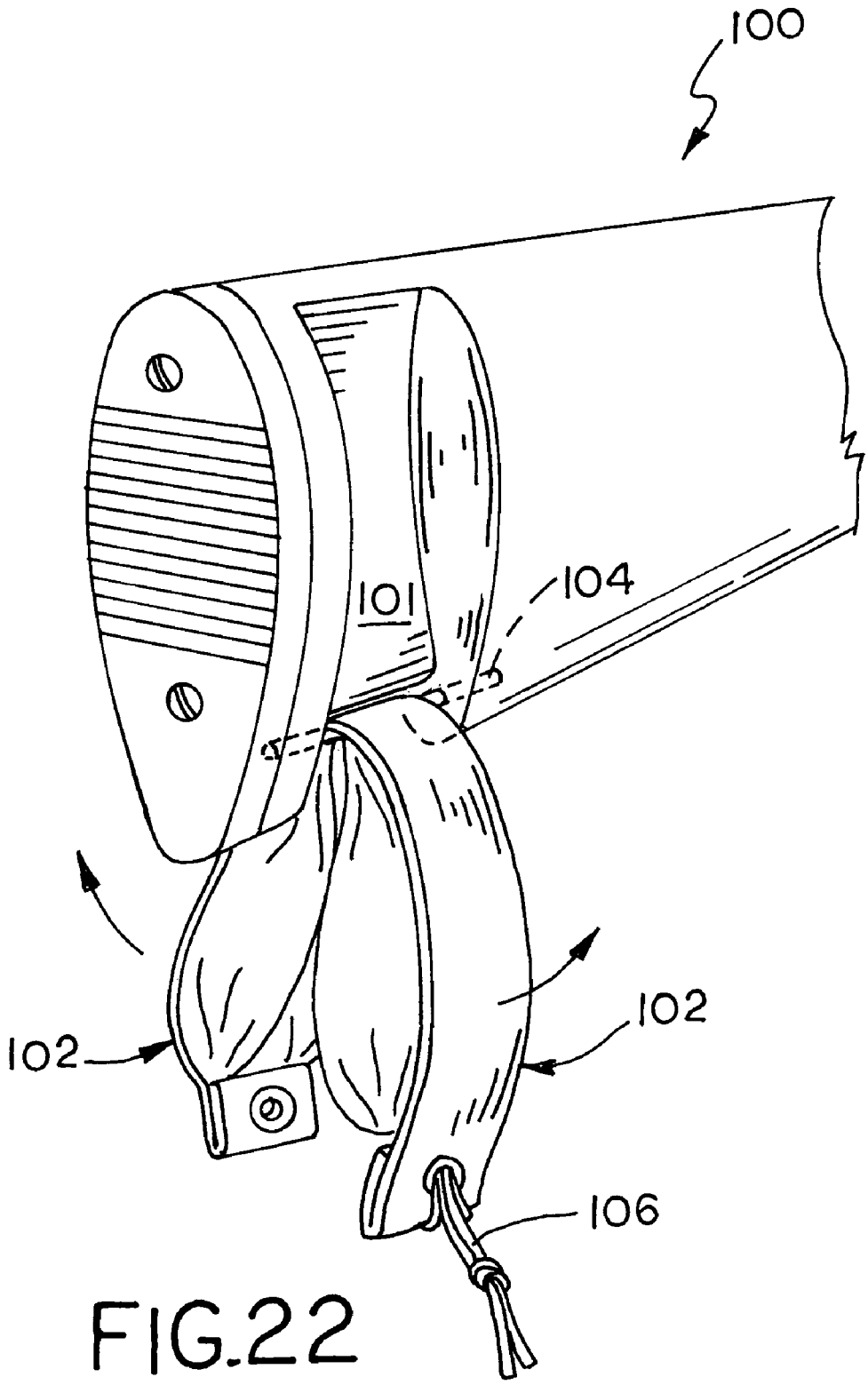
FIG. 22 is a perspective view of an embodiment of the firearm support device incorporated into a rifle stock.
Figure 23:
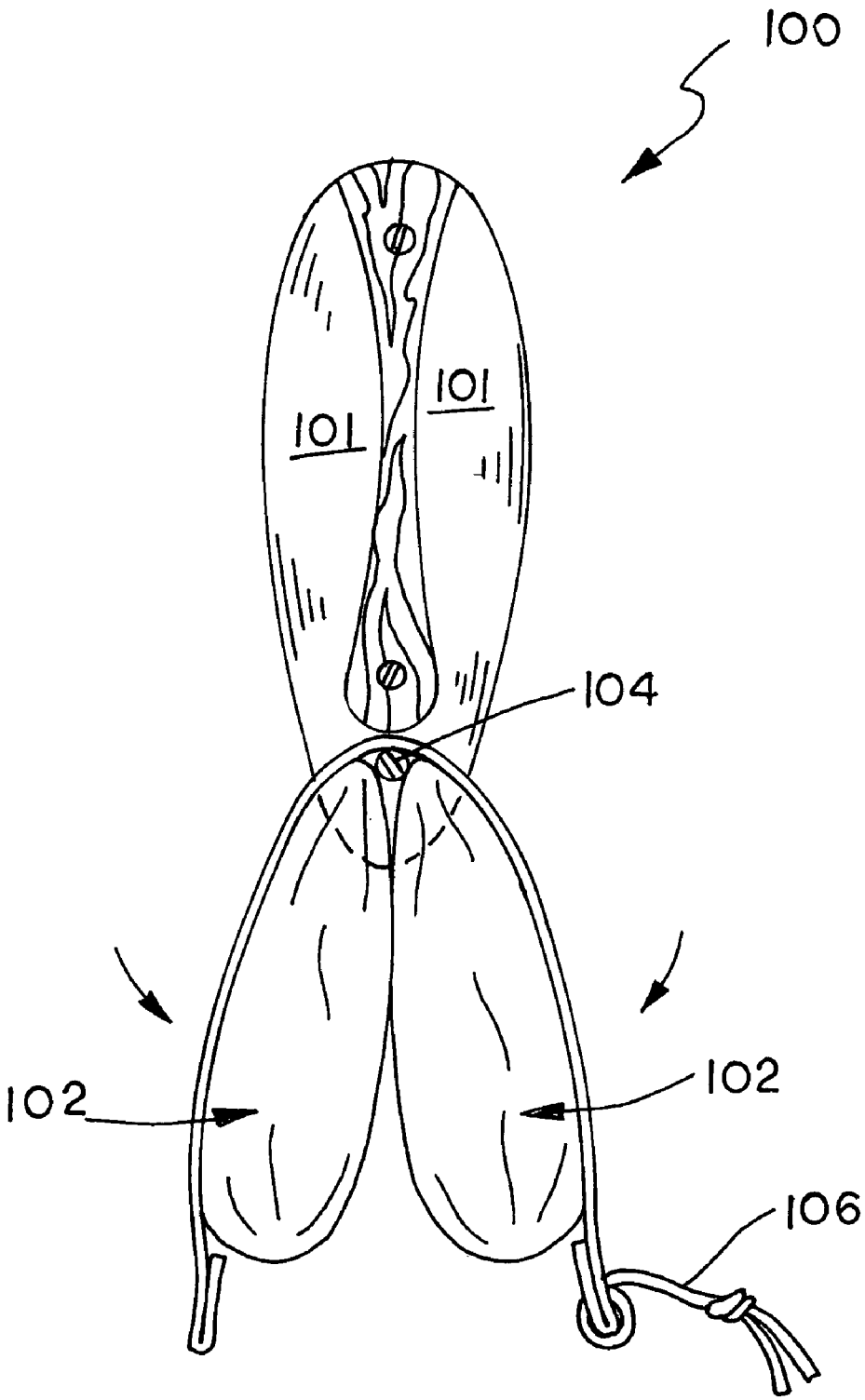
FIG. 23 is an end view of the embodiment of FIG. 22 showing the bean bag in the support position.
Figure 25:
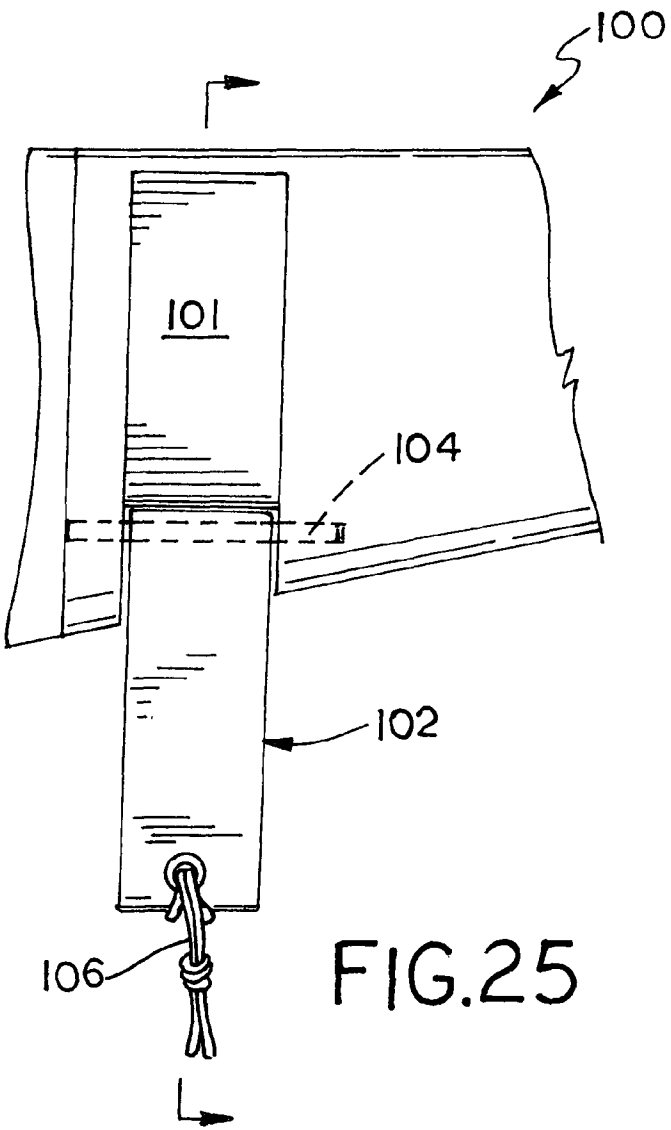
FIG. 25 is a side view of the embodiment of FIG. 22 showing the bean bag in the support position.
Figure 24:
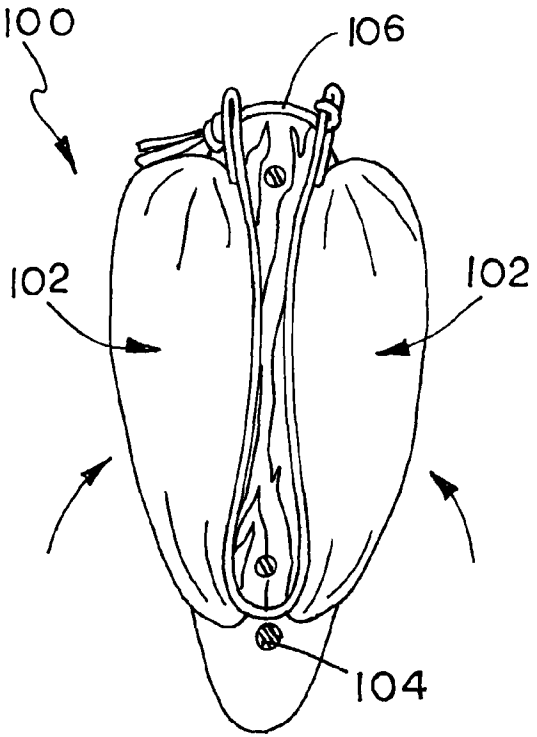
FIG. 24 is an end view of the embodiment of FIG. 22 showing the bean bag in the transportation position.

FIGS. 19-21 illustrate alternative embodiments of this invention where the firearm support device incorporates examples of different mechanisms for securing the beanbags in the folded transportation position. FIG. 19 shows a support device 70 where beanbags 72 are secured by patches of hoop and loop fasteners 74 sewn to the spine end tabs 75. FIGS. 20 and 21 shows support devices 80 and 90 where the beanbags are secured using a quick release buckle 82 and snap fasteners 92 attached to the spine web tabs, respectively. While the knotted elastic cord of the first embodiment provides a near silent and secure connection mechanism, hoop and loop patches, buckles, snaps and other fasteners may be employed to secure the beanbags in the transportation position within the teaching of this invention.

FIGS. 22-25 illustrate an embodiment of the firearm support device of this invention incorporated directly into the body of a rifle stock, which is designated generally as reference numeral 100. As shown, rifle stock 100 includes a pair of beanbags 102 pivotally connected to the stock by a roll pin 104. Rifle stock 10 also has two side cavities 101 within which beanbags 102 are seated when in the transportation position. Cavities 101 allow beanbags 102 to seat relatively flush with the sides of rifle stock 100 when in the transportation position. Again, beanbags 102 are secured in the transportation position by knotted elastic cord 106, which simply wraps over the top of rifle stock 100.

One skilled in the art will note several advantages that the various embodiments of this invention have over the conventional beanbags used by sniper and other long distance shooters. Each of the firearm support devices embodying the present invention include a stock attachment that connects one or more beanbags directly to a rifle stock and allows the beanbags to be pivoted between a secured transportation position against the side of the stock and a support position suspended under the stock. Because the beanbags are directly mounted to the weapon, the shooter has less gear to pack and manage while moving between shooting positions. With the beanbags secured tightly against the rifle stock in the transportation position, the shooter can move stealthfully between shooting position. Once a shooting position is reached, a shooter can quickly and quietly deploy the beanbags from their secure transportation position to their support position and use the beanbags to support and stabilize the rifle stock for an accurate shot. It should also be noted that the support device does not hinder the shooter's use of the weapon in any way. The support device mounts to the end of the stock where it is out of the way of the shooter's head and face while the shooter obtains a normal sight picture. Even if the shooter aims the weapon with the beanbags in the transportation position, the beanbags are held against the stock behind the shooter's face and do not contact the shooter's head or face. Consequently, the support device does not need to be deployed into the shooting position in order for the shooter to fire the weapon.

The support devices add little weight to the weapon and can be fitted to any conventional rifle stock. The cinch and stirrup straps secures the support device to the end of the rifle stock and prevent it from moving up the stock. The support devices are designed for rugged tactical environments and are constructed of lightweight, durable and water-resistant materials. The beanbags are constructed of durable nylon fabric and are filled with lightweight inert plastic pellets or sand. The stock attachments are constructed of lengths of nylon webbing and use strong lightweight plastic buckles, snaps, quick release fasteners and velcro attachment patches. The beanbag fabric and filling allows the shooter to easily manipulate and squeeze the beanbags to adjust and stabilize the elevation of the rifle stock.

In one embodiment, the support device uses a knotted elastic cord to provide a secure but silent connection mechanism for securing the beanbags in the transportation position. In another embodiment, the support device allows two bean bags to be used in a side-by-side orientation or in a stacked orientation while still integrally connected to the stock attachment for pivotal movement between the transportation position and the support position. In another embodiment, the support mechanism uses a single large beanbag that can be shifted in the support position between a horizontal and vertical orientation. Other embodiments incorporate different types of fastening mechanism for securing the stock attachment to the stocks and for securing the beanbags in the transportation position.

Although illustrated with a firearm, it should also be noted that the teachings of this invention can be readily applied to other hand-held or shoulder supported devices that must be similarly steadied by a user for accuracy. For example, the support devices of this invention can be modified for use with electronic range finders and laser designators. The support devices can be incorporated into the design of such devices or simply attached using the stock attachment with little modification.

The embodiments of the present invention herein described and illustrated are not intended to be exhaustive or to limit the invention to the precise form disclosed. They are presented to explain the invention so that others skilled in the art might utilize its teachings. The embodiment of the present invention may be modified within the scope of the following claims.

I claim:

1. A firearm support device for supporting and stabilizing the stock of a rifle comprising:

a stock attachment for affixing the support device to the stock, the stock attachment includes a first strap part for mounting circumferentially around the stock and a second strap part sewn to the first strap for extending across the end of the stock;

an oblong beanbag connected to the stock attachment for pivotal movement between a first position abutting the stock and a second position spaced from and suspended under the stock, the beanbag also includes a third strap part mounted directly to and overlying the beanbag, the third strap part shiftably connected to the stock attachment to allow the beanbag to slide relative to the stock when in the second position between a first orientation where the beanbag is positioned axially vertical and a second orientation where the beanbag is axially horizontal; and means for securing the beanbag against the stock when in the first position.

2. The firearm support of claim 1 wherein the securing means includes a tab sewn to the beanbag and having an eyelet formed therein, and a length of elastic cord having one end secured to the stock attachment and the opposite end having a knot tied therein for forceable insertion through the eyelet of the tab of the beanbag such that the knot will only allow the opposite end of the elastic cord to pull from the beanbag tab under manual force.

3. The firearm support device of claim 1 wherein the beanbag has a rectangular shape.

4. The firearm support of claim 1 wherein the securing means includes a buckle.

5. The firearm support of claim 1 wherein the securing means includes a snap part.

6. The firearm support of claim 1 wherein the securing means includes hook and loop fasteners.

7. The firearm support of claim 1 wherein the stock attachment also includes a strap fastener for securing the first strap around the stock, so as to allow the first strap part to securely tighten around the stock.

8. The firearm support of claim 1 wherein the stock attachment also includes a ring part mounted to the first strap part so as to hang under the stock when the stock attachment is mounted to the stock, the third strap part extending axially through the ring part such that the third strap part slides through the ring part when the bean moves between the first orientation and the second orientation.

9. A firearm support device for supporting and stabilizing the stock of a rifle comprising:

a stock attachment for affixing the support device to the stock, the stock attachment includes a first strap for mounting around the stock, a second strap part sewn to the first strap for extending across the end of the stock, and a ring part mounted to the first strap to hang under the stock when the stock attachment is mounted to the stock;

an oblong beanbag connected to the ring part for pivotal movement between a first position abutting the stock and a second position suspended and spaced from the stock, the bean bag includes a third strap part mounted to and overlying the beanbag, the third strap part extending axially through the ring part so as to allow the beanbag to slide relative to the stock when in the second position between a first orientation where the beanbag is positioned axially vertical and a second orientation where the beanbag is axially horizontal.

* * * * *